United States Patent [19]

Kurtz

[11] Patent Number: 4,503,301

[45] Date of Patent: Mar. 5, 1985

[54] DIFFERENTIAL FLUID PRESSURE SWITCH

[75] Inventor: Ronald C. Kurtz, Irwin, Pa.

[73] Assignee: American Standard Inc., Wilmerding, Pa.

[21] Appl. No.: 478,436

[22] Filed: Mar. 24, 1983

[51] Int. Cl.[3] ..... H01H 35/40

[52] U.S. Cl. ..... 200/83 D; 200/83 J; 200/83 Y; 200/83 SA

[58] Field of Search ..... 200/82 D, 82 DA, 83 A, 200/83 D, 83 J, 83 S, 83 SA, 83 Y, 83 R

[56] References Cited

U.S. PATENT DOCUMENTS

| | | | |
|---|---|---|---|
| 3,206,572 | 9/1965 | Buehler | 200/83 |
| 3,262,387 | 7/1966 | Reams | 200/83 R X |
| 3,475,573 | 10/1969 | Maltais et al. | 200/82 |
| 3,951,469 | 4/1976 | Hayashida | 200/82 D |
| 3,967,082 | 6/1976 | Remy | 200/82 D |
| 3,980,987 | 9/1976 | Ishigami et al. | 200/82 D |
| 4,220,836 | 9/1980 | Hersey | 200/83 S X |
| 4,404,440 | 9/1983 | Busche | 200/83 J X |

FOREIGN PATENT DOCUMENTS

| | | | |
|---|---|---|---|
| 715182 | 8/1965 | Canada | 200/83 J |

*Primary Examiner*—A. D. Pellinen
*Assistant Examiner*—Susan Steward
*Attorney, Agent, or Firm*—G. E. Hawranko

[57] ABSTRACT

A fluid pressure switch includes a housing with a cylindrical bore, a spring housing bore and a guide bore between the cylindrical bore and the spring housing bore. A shaft member axially disposed in the housing between the bore, has a piston element secured on the end within the cylindrical bore for movement in one direction or another upon a differential between fluid pressure sources as presented to the two opposing surfaces of the piston element. A spring-biasing arrangement is secured to the shaft member on the end within the spring housing bore for opposing movement of the shaft member. The spring-biasing arrangement is adjustable both as to the spring force and as to the spring stop setting. A switch operator member secured to the piston member, spreads contact arms apart upon a predetermined displacement of the piston. The switch operator member has an elliptically-shaped eccentric portion which can be rotated to adjust the point of shaft displacement at which switch operation occurs.

18 Claims, 3 Drawing Figures

DIFFERENTIAL FLUID PRESSURE SWITCH

BACKGROUND OF THE INVENTION

This invention pertains to a differential fluid pressure switch used for comparing two fluid pressure inputs and thereby opening a switch contact if a threshold fluid pressure level is exceeded. Such differential fluid pressure switches are typically used on transportation vehicles having front and rear truck units, each of which is equipped with a fluid pressure operated braking system. Fluid pressure comparing devices for such applications typically have designated one input as the high level input and the other input as the low level input. Such a rigid construction does not allow for detection of a condition where the fluid pressure levels are opposite to the preset arrangement. Another feature previously found in a typical differential fluid pressure switch is the use of a preloaded spring or springs for causing the switch contacts to change position. Additionally, another spring would be used to bias the fluid pressure sensitive element which was set to move in response to a predetermined fluid pressure differential. This reliance on a plurality of springs with the inherent spring characteristics, results in high installation and maintenance costs, as shown, for example, by the need to match spring constants of opposing springs, and the need to replace springs whose spring constants have changed due to time and wear. To date, differential fluid pressure switches have also required multiple seal and diaphragm arrangements to be effective. Such an arrangement contributes further to the high maintenance costs which have been typical for such differential fluid pressure switches.

SUMMARY OF THE INVENTION

The object of the present invention, therefore, is to provide a differential fluid pressure switch capable of comparing fluid pressure from two inlets regardless of which is high or low.

It is a further object of this invention to reduce installation and maintenance costs by minimizing the number of components subject to wear and the number of components whose performance characteristics are critical, examples of which are seals and springs.

It is still a further object of this invention to allow external adjustment of components whose performance characteristics are critical thereby virtually eliminating the need to disassemble a device when the operations' criteria are not fully within specification.

Briefly, the invention comprises a differential fluid pressure switch having two fluid pressure inlets, each leading to a separate fluid pressure chamber. A diaphragm forms a movable wall for each of the fluid pressure chambers such that, when one diaphragm moves in response to a fluid pressure differential, the second diaphragm moves in opposition to the first. A shaft member is longitudinally disposed within the housing for transverse movement in response to a fluid pressure differential between the two pressure chambers. The two diaphragms are coaxially secured to the shaft member by cup-shaped pistons and retaining plates. An adjustable spring arrangement is also disposed on the shaft member and occupies a spring storage bore formed in the housing. A contact eccentric member carried on the shaft member between the two diaphragms opens the switch contacts if a fluid pressure differential exceeding a predetermined threshold level occurs.

DESCRIPTION AND OPERATION

Figure 1:
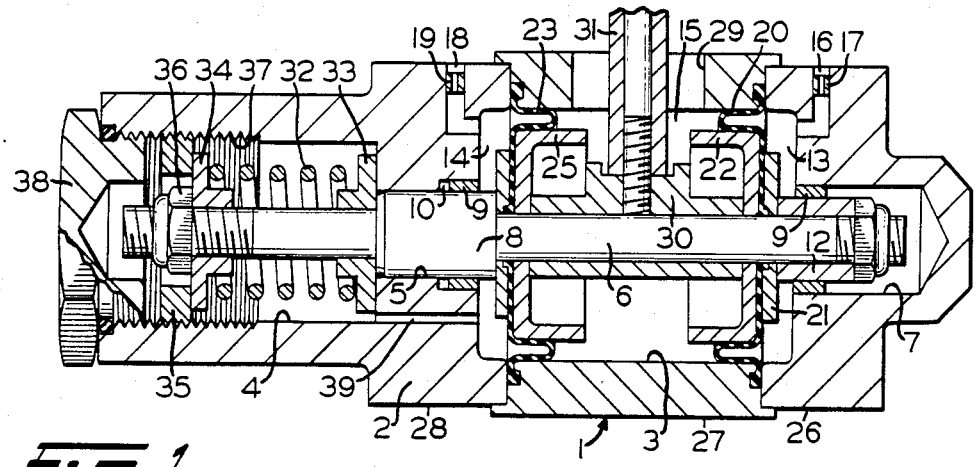
FIG. 1 is an elevational view shown in partial section of a differential fluid pressure switch embodying the invention.

As shown in FIG. 1, a differential fluid pressure switch 1, embodying the invention, comprises a housing 2 having a cylindrical bore 3 at one end, and a spring housing bore 4 at the opposite end. A first guide bore 5 is formed between the cylindrical bore 3 and the spring housing bore 4 at approximately the middle of the housing 2. A non-rotating, but axially movable shaft member 6, is coaxially disposed within the housing 2. The shaft member 6 extends from the spring housing bore 4 on one end to a second guide bore 7, formed in the housing 2 adjacent the cylindrical bore 3. To insure smooth, axial travel of the shaft member 6, a collar portion 8 is formed on the portion of the shaft member 6 that occupies the first guide bore 5. A first low friction bearing such as, for example, a teflon-coated bearing 9 is disposed with a bearing slot 10 formed in a portion of the first guide bore 5. The first low friction bearing 9 acts on the shaft collar portion 8 to guide the shaft member 6 during axial movement. A second low friction bearing 11 is disposed in the second guide bore 7 and acts upon a bushing 12, which is secured to the end of the shaft member 6.

As further seen in FIG. 1, the cylindrical bore 3 is divided into three chambers 13, 14, 15. There is a first fluid pressure chamber 13, a second fluid pressure chamber 14, and an atmospheric chamber 15 located between the first and second fluid pressure chambers 13, 14. A first pressure inlet 16 communicates with the first fluid pressure chamber 13 for introducing the fluid pressure from either the front or rear truck unit (not shown) to the first fluid pressure chamber 13. A first throttle 17 in the first pressure inlet 16 provides restriction thereby preventing a rapid pressurization of the first fluid pressure chamber 13. A second pressure inlet 18 communicates with the second fluid pressure chamber 14 for introducing the fluid pressure from the remaining truck unit (not shown) to the second fluid pressure chamber 14. A second throttle 19 in the second pressure inlet 18 provides restriction thereby preventing a rapid pressurization of the second fluid pressure chamber 14.

A first diaphragm 20 is disposed within the cylindrical bore 3 to provide a movable boundary for the first fluid pressure chamber 13 which, because this first diaphragm 20 is secured to the shaft member 6, causes axial movement of the shaft member 6 in either direction as a result of a fluid pressure differential. This first diaphragm 20 is secured to the shaft member 6 by a first retaining plate 21 coaxially positioned on the side of the first diaphragm 20 facing the first fluid pressure chamber 13. The first diaphragm 20 is supported on the opposite side, that is, the side facing the atmospheric chamber 15, by a first cup-shaped piston 22. The first diaphragm 20 is frictionally supported along the outer circumference by a circumferential fit between a first end portion 26 and a middle portion 27 of the housing 2. All contact surfaces to this first diaphragm 20 are of a smooth rounded nature, thereby reducing the wear tendencies typically experienced with a rolling diaphragm.

A second diaphragm 23 is disposed within the cylindrical bore 3 to provide a movable boundary for the second fluid pressure chamber 14. This second diaphragm 23 is also secured to the shaft member 6 such that movement of the second diaphragm 23, due to a fluid pressure differential, causes axial movement of the shaft member 6. This shaft 6 movement can be in either direction, depending on whether the high pressure relative to the low pressure has occurred in the first fluid pressure chamber 13 or the second fluid pressure chamber 14. This second diaphragm 23 has an identical effective area as the first diaphragm 20 and is secured to the shaft member 6 in a similar manner as the first diaphragm 20. A second retaining plate 24 is coaxially positioned on the side of the second diaphragm 23, facing the second fluid pressure chamber 14. The second diaphragm 23 is supported on the opposite side, that is, the side facing the atmospheric chamber 15, by a second cup-shaped piston 25. The second diaphragm 23 is frictionally secured along the outer circumference by a circumferential fit between the middle portion 27 and the second end portion 28 of the housing 2. The contact surfaces of the second diaphragm 23 are also of a smooth, rounded nature to reduce wear tendencies.

The atmospheric chamber 15, formed in the cylindrical bore 3 between opposing first and second diaphragms 20, 23 and opposing first and second cup-shaped pistons 22, 25, has a guide slot 29 which is open to atmosphere. The portion of the shaft member 6 extending through the atmospheric portion of the cylindrical bore 3 has an extension collar 30 secured thereon, which extends between the first and second cup-shaped pistons 22, 25. In addition to maintaining the first and second cup-shaped pistons 22, 25 in their stationary position on the shaft member 6, the extension collar 30 serves to fasten a switch operator 31 to the shaft member 6 at an angle perpendicular to the direction of travel of the shaft member 6. The switch operator 31 extends through the guide slot 29 where, upon movement of the shaft member 6 in either direction, due to a fluid pressure differential, the switch contacts open, thus effecting an operation of the differential fluid pressure switch 1.

Movement of the shaft member 6 can only occur if sufficient force corresponding to a fluid pressure differential is present to overcome the spring force of an adjustable spring arrangement located in the spring housing bore 4. The spring force is adjustable, as will later be described in more detail; however, some positive setting is required to prevent an oscillating motion of the shaft member 6, as could occur if slight differentials in fluid pressure were permitted to influence shaft member 6 movement. By setting the spring force to a predetermined measurable value, shaft member 6 movement can only occur if the fluid pressure differential is substantial, as could correspond to a problem in the brake system, the type of condition which this fluid pressure switch 1 is designed to detect. The spring 32 surrounds the shaft member 6 and occupies substantially all of the spring housing bore 4. One end of the spring 32 abuts a spring seat 33, which surrounds the shaft member 6 on the side of the spring housing bore 4 adjacent the first guide bore 5. The opposite end of the spring 32 abuts a spring follower 34, which surrounds the shaft member 6 in the spring housing bore 4 on the side opposite to where the spring seat 33 is located. Both the spring seat 33 and the spring follower 34 are coaxially slidable along the shaft member 6. Located adjacent to the spring follower 34, and axially movable within the spring housing bore 4, is a spanner collar 35. The spanner collar 35 serves as an adjustable cage limit to the spring 32. A nut 36, which is threaded to the end of the shaft member 6, bears against the spring follower 34. Tightening or loosening the nut 36 axially moves the spring follower 34, which has the effect of increasing or decreasing the spring load constant as required. The spanner collar 35 can be adjusted along the threaded portion 37 of the spring housing bore 4 to effect a cage limit corresponding to the setting of the spring valve. An end cap 38 is secured to the second end portion 28 of the housing 2 protecting the nut 36-spanner collar 35 arrangement, and seals the spring housing bore 4.

A reduced passageway 39 connects the second fluid pressure chamber 14 and the spring housing bore 4, thereby equalizing the fluid pressure between the second fluid pressure chamber 14 and the spring housing bore 4. This passageway 39 effectively eliminates the need for a dynamic seal within the first guide bore 5 yet, at the same time, does not detrimentally affect the second pressure chamber since the size of the throttle 19 has been sized to allow for the volume of the second fluid pressure chamber 14.

Figure 2:
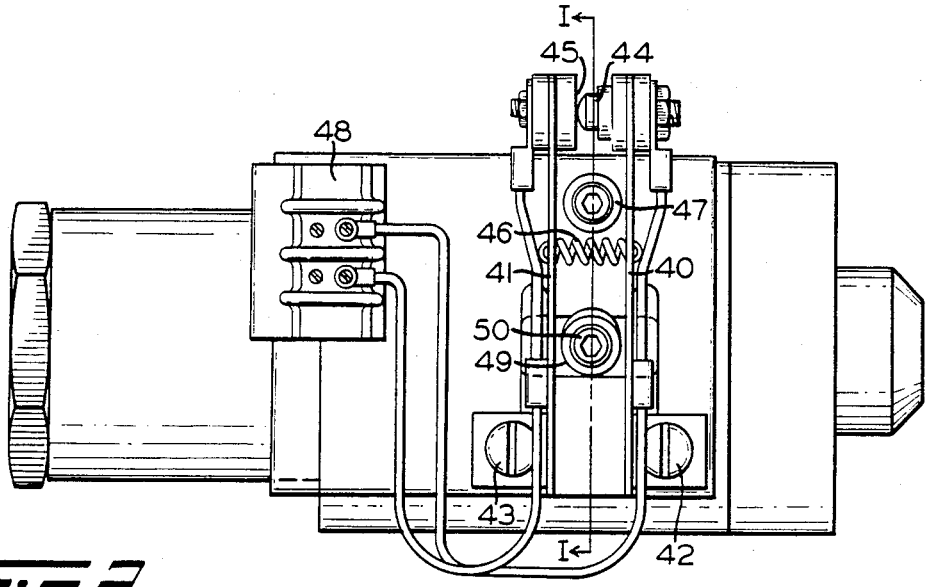
FIG. 2 is a plan view of a differential fluid pressure switch similar to that shown in FIG. 1 embodying the invention.

As seen in FIG. 2, secured externally to the middle portion 27 of the housing 2 are two contact arms 40, 41. A first shouldered screw 42 secures the first contact arm 40 such that the arm 40 projects transversely to one end of the guide slot 29. A second shouldered screw 43 secures the second contact arm 41 such that the arm 41 projects transversely to the end of the guide slot 29 opposite the first contact arm 40. Secured to the first contact arm 40 at the end opposite the first shouldered screw is a first contact element 44. Secured to the second contact arm at the end opposite the second shouldered screw 43 is a second contact element 45. Under normal operating conditions, that is, no fluid pressure differential detected, the first and second contact elements 44, 45 are touching. This is typically referred to as a normally closed condition; the advantages of this approach, under adverse conditions, will be explained later. A tension spring 46 is secured to both the first and second contact arms 40, 41 to assist in maintaining closure of the contact elements 44, 45 during a condition of low or no fluid pressure differential. A contact stop 47 is secured to the middle portion 27 of the housing 2 between the first and second contact arms 40, 41. This contact stop 47 is only effective to prevent one of the contact arms 40 or 41 from following the other contact arm 40 or 41 in the event of a threshold fluid pressure differential being detected. A terminal connection 48 is mounted on the middle portion 27 of the housing 2 and provides electrical connection to both contact elements 44, 45, as shown in FIG. 2.

Figure 3:
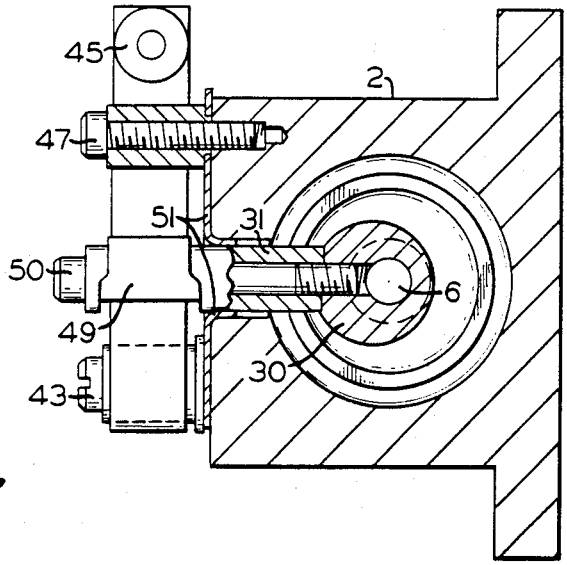
FIG. 3 is a cross-sectional view of a differential fluid pressure switch taken along line I—I of FIG. 2.

As seen in FIG. 3, the switch operator 31 has an eccentric portion 49 located between the first and second contact arms 40, 41. The oblong-like shape of the eccentric portion 49 can be rotated by means of the keyed locking screw 50. By so rotating the switch operator 31 and, hence, eccentric portion 49, the point at which the contact elements 44, 45 open can be adjusted to compensate for size and performance variations of the components which comprise the differential fluid pressure switch 1. Loosening the keyed locking screw 50 allows rotation only of the eccentric portion 49; the switch operator portion 31 connected to the shaft member 6 is prevented from rotating about the centerline of the shaft 6 by the guide members 51; non-rotation about the centerline of the shaft 6 of the switch operator portion 31 is necessary to prevent twisting of the first and second diaphragms 20, 23.

In operation, fluid pressure from the braking system of either the front or rear truck unit (not shown) is communicated to the first pressure inlet 16. This fluid pressure enters the first pressure chamber 13 in a throttled manner due to the use of the first throttle 17 located within the first pressure inlet 16. Fluid pressure from the braking system of the remaining truck unit (not shown) is communicated to the second pressure inlet 18. This fluid pressure enters the second pressure chamber 14 in a throttled manner due to the use of a second throttle 19 located within the second pressure inlet 18.

Under normal operating conditions of the respective front and rear braking systems, the two separate fluid pressure levels will be virtually identical. If a slight variation in the two fluid pressure levels were to exist, movement of the shaft member 6, sufficient to open the contact elements 44, 45, would be prevented by the operation of the spring 32. The method by which the spring 32 opposes the movement of the shaft member 6 is dependent upon the direction of motion of the shaft member 6. If the fluid pressure in the first pressure chamber 13 is the slightly higher, the first diaphragm 20 will be urged to the left, thus attempting to move the shaft member 6 to the left. The shaft collar portion 8 will then exert a force against the spring seat 33 which will bear against the spring 32, the spring follower 34, and the spanner collar 35, which serves as the spring 32 stop. The slight force corresponding to the slight fluid pressure differential is not sufficient to overcome the spring force and compress the spring 32; consequently, shaft member 6 remains in the middle position associated with normal braking conditions.

If the fluid pressure in the second pressure chamber 14 is slightly higher, the second diaphragm 23 will be urged to the right, thus attempting to move the shaft member 6 to the right. As the shaft member 6 attempts to move to the right, a force is exerted through the nut 36 to act against the spring follower 34. The spring follower 34 then bears against the spring 32, which bears against the spring seat 33. The spring seat 33 bears against the portion of the housing 2, marking the right-hand boundary of the spring housing bore 4. The slight force corresponding to the slight fluid pressure differential is not sufficient to overcome the spring force and compress the spring 32; consequently, shaft member 6 remains in the middle position associated with normal braking conditions.

In the event more than a slight fluid pressure differential between the first and second pressure chamber 13, 14 does occur, the spring force will not be sufficient to prevent shaft member 6 movement. If the fluid pressure in the first pressure chamber 13 is the sufficiently higher, the first diaphragm 20 will be urged to the left, thus moving the shaft member 6 to the left. The shaft collar portion 8 will then exert a force against the spring seat 33, which will bear upon one end of the spring 32. An opposing force will be exerted on the opposite end of the spring 32 through the spanner collar 35 and the spring follower 34. At this point, the force exerted by the first diaphragm 20 is sufficient to overcome the spring force, thereby compressing the spring 32. As the shaft member 6 travels to the left, the switch operator portion 31 is carried along in the same direction. Referring now to the external view in FIG. 2, the eccentric portion 49, which is disposed between the first and second contact arms 40, 41, moves to the left and bears against the second contact arm 41. The second contact arm 41 begins to rotate about the second shouldered screw 43. The contact elements 44, 45 initially remain in the closed position due to the influence of the tension spring 46, which effectively pulls the first contact arm 40 along with the second contact arm 41. Continued movement of the eccentric portion 49 causes the second contact arm 41 to rotate further. The first contact arm 40 eventually is restrained from further following movement by the contact stop 47. At this point, the first and second contact elements 44, 45 open and the information that a fluid pressure differential has occurred is available at terminal connection 48.

When the fluid pressure levels in the braking systems (not shown) are normalized, the shaft member 6 is returned to the neutral position under the force of spring 32. The eccentric portion 49 no longer bears against the second contact arm 41, thus allowing the second contact arm 41 to rotate about the trunnion point, the second shouldered screw 43, and return to the normal position. The movement of the second contact arm 41 back to the normal position will assist the first contact arm 40 to move away from the contact stop 47 to resume a normal position by virtue of the contact 45 striking contact 44. The contact stop 47 is smaller than the width between the first and second contact arms 40, 41; consequently, when the second contact arm 41 causes the first contact arm 40 to move back to a normal position, the first and second contact elements 44, 45 wipe together, disturbing any oxide films that may have accumulated. The tension spring 46 is of such a spring constant as to prevent bounce of the first and second contact elements 44, 45 upon return to closure.

Operation of the differential fluid pressure switch 1, when the second pressure chamber 14 is at the higher level, is substantially similar to the above discussion. Under these conditions, the second diaphragm 23 will be urged to the right, thus moving the shaft member 6 to the right. The nut 36, which is threaded to the shaft member 6, will act against the spring follower 34, which will exert a force against one end of the spring 32. The spring seat 33, which bears against a portion of the housing 2, exerts a force on the opposite end of the spring. At this point, the force exerted by the second diaphragm 23 is sufficient to compress the spring 32. As the shaft member 6 travels to the right, the switch operator portion 31 is carried along in the same direction. The eccentric portion 49, located between the first and second contact arms 40, 41, will move to the right and bear against the first contact arm 40. The first contact arm 40 begins to rotate about the first shouldered screws 42. The first and second contact elements 44, 45 initially remain closed due to the influence of the tension spring 46. Continued movement of the eccentric portion 49 causes the first contact arm 40 to rotate further. The second contact arm 41 is restrained from further following movement by the contact stop 47. At this point, the first and second contact elements separate, causing an open circuit condition at the terminal connection 48.

Upon normalization of the fluid pressure levels in the braking systems (not shown), the shaft member 6 is returned to the neutral position under the influence of the spring 32. The first contact arm 40 is free to rotate back about the trunnion point, the first shouldered screw 42, and return to the normal position. Contact elements 44, 45 experience a wiping operation, as previously discussed. Contact bounce is also prevented in the manner as previously discussed.

With the principal embodiment of the invention now having been fully detailed, it should be appreciated that alternate embodiments are possible. As an example, the switch arrangement shown in FIG. 2 can be replaced by an encapsulated switch thus protecting the contact element from the environment.

It is also possible to install a second set of switch contacts to the body of the device 1 which could be operated by the switch operator 31 to indicate which pressure chamber is at the higher fluid pressure level.

Yet another embodiment could include a single piston element disposed within the cylindrical bore 3 which would be large enough to secure both the first and second diaphragms 20, 23 and still further, secure the switch operator 31. Such an arrangement would also be effective to substantially block accumulation of dirt and particulate matter that may otherwise accrue in the atmospheric chamber portion 15.

Although the hereinabove-described forms of embodiments of the invention constitute preferred forms, it can be appreciated that other modifications may be made thereto without departing from the scope of the invention as set forth in the appended claims.

Having now described the invention, what I claim as new and desire to secure by Letters Patent is:

1. A fluid pressure switch for detecting a fluid pressure differential between multiple fluid pressure sources, said fluid pressure switch comprising:

(a) a housing having a cylindrical bore formed in one end, a spring housing bore formed in the opposite end, and a first guide bore formed intermediate said cylindrical bore and said spring housing bore;

(b) a shaft member coaxially disposed within said housing, extending into said cylindrical bore, said first guide bore, and said spring housing bore, said shaft member being axially movable within said housing;

(c) a piston member fixedly mounted on the portion of said shaft member located in said cylindrical bore, said piston member having opposing first and second surfaces formed on respective first and second cup-shaped portions coaxially disposed on said shaft member, and an extension collar coaxially disposed on said shaft member between said first and second cup-shaped portions;

(d) passageway means in said housing for communicating fluid pressure sources to respective opposing surfaces of said piston, such that such fluid pressures act on said piston member such that the differential pressure causes axial movement of said shaft member in a first direction toward said spring housing bore upon higher fluid pressure on the first surface of said piston member and a second direction, away from said spring housing bore, upon higher fluid pressure on the second surface of said piston member;

(e) a fixed shoulder stop formed on said shaft member adjacent said piston member;

(f) an adjustable stop coupled to the end of said shaft member adjacent said spring housing bore, said adjustable stop being axially spaced apart from said fixed shoulder stop;

(g) spring means disposed between said fixed shoulder stop and said adjustable stop for providing a biasing force against said fixed shoulder stop upon movement of said shaft member in said first direction, and against said adjustable stop upon movement of said shaft member in said second direction;

(h) an abutting portion formed in said housing adjacent said fixed shoulder stop and positioned to contact the end of said spring means bearing against said fixed shoulder stop as said shaft member moves in said first direction;

(i) an adjustable abutting member attached to said housing adjacent said adjustable stop and positionable within an axial range to contact the end of said spring means bearing against said adjustable stop as said shaft member moves in said second direction;

(j) a switch means attached to said housing for selectively providing an electrical connection indicating the pressure relationship between fluid pressure sources; and (k) a switch operator means extending from said piston member for engaging said switch means in response to axial movement of said piston member, said switch operator means having an elliptically-shaped eccentric portion extending from said extension collar and being movable along therewith, said eccentric portion being axially rotatable such that a range of displacement of said shaft member over which said switch means operates is provided.

2. A fluid pressure switch, as set forth in claim 1, wherein said spring means includes a compression spring, a spring seat slidably disposed on said shaft member adjacent said fixed shoulder stop, and a spring follower slidably disposed on said shaft member adjacent said adjustable stop.

3. A fluid pressure switch, as set forth in claim 1, wherein said adjustable abutting member comprises a spanner collar threadably engaged to a portion of said spring housing bore.

4. A fluid pressure switch, as set forth in claim 1, wherein said adjustable stop comprises a nut threadably coupled to said shaft member whereby said spring means can be adjusted to a predetermined spring value by rotating said nut.

5. A fluid pressure switch, as set forth in claim 1, wherein said passageway means includes throttles to restrict flow in said passageway means.

6. A fluid pressure switch, as set forth in claim 1, wherein a first rolling diaphragm is secured to said first surface of said piston member and a second rolling diaphragm is secured to said second surface of said piston member.

7. A fluid pressure switch, as set forth in claim 1, wherein said shaft member is guided in axial direction by a first low friction bearing disposed in said first guide bore to contact said fixed shoulder stop, and by a second low friction bearing disposed in the end of said housing adjacent said cylindrical bore to contact a bushing member fixedly secured to the end of said shaft member opposite said adjustable stop.

8. A fluid pressure switch, as set forth in claim 1, wherein said switch means includes a first contact arm secured on one end to said housing, a first contact member secured to the opposite end of said first contact arm, a second contact arm secured to said housing in parallel relation to said first contact arm at the end corresponding to said secured end of said first contact arm, a second contact member secured to the end of said second contact arm corresponding to said contact end of said first contact arm, a stop member secured to said housing between said parallel first and second contact arms, and a tension spring secured to said first and second contact arms such that, movement of said first contact arm initially results in a following movement by said second contact arm until said second contact arm contacts said contact stop halting further following movement, and vice versa, where movement of said second contact arm initially results in a following movement by said first contact arm until said first contact arm contacts said contact stop halting further following movement.

9. A fluid pressure switch, as set forth in claim 8, wherein said spring means includes a compression spring, a spring seat slidably disposed on said shaft member adjacent said fixed shoulder stops, and a spring follower slidably disposed on said shaft member adjacent said adjustable stop.

10. A fluid pressure switch, as set forth in claim 9, wherein a first rolling diaphragm is secured to said first cup-shaped portion and a second rolling diaphragm is secured to said second cup-shaped portion.

11. A fluid pressure switch, as set forth in claim 9, wherein said adjustable abutting member comprises a spanner collar threadably engaged to a portion of said spring housing bore.

12. A fluid pressure switch, as set forth in claim 11, wherein said adjuatable stop comprises a nut threadably coupled to the end of said shaft member adjacent said spring means, said nut being rotatable thereby allowing adjustment of said spring means to a predetermined spring value.

13. A fluid pressure switch, as set forth in claim 12, wherein a reduced passageway is formed in said housing to provide communication between said spring housing bore and the portion of said cylindrical bore bordered by said second rolling diaphragm.

14. A fluid pressure switch, as set forth in claim 13, wherein a first throttled pressure inlet is formed in said housing to communicate one fluid pressure source to the portion of said cylindrical bore bordered by said first rolling diaphragm, and a second throttled pressure inlet formed in said housing to communicate a second fluid pressure source to the portion of said cylindrical bore bordered by said second rolling diaphragm.

15. A fluid pressure switch for detecting a fluid pressure differential between multiple fluid pressure sources, said fluid pressure switch comprising:

(a) a housing having a cylindrical bore formed in one end, a spring housing bore formed in the opposite end, and a first guide bore formed intermediate said cylindrical bore and said spring housing bore;

(b) a shaft member coaxially disposed within said housing, extending into said cylindrical bore, said first guide bore, and said spring housing bore, said shaft member being axially movable within said housing;

(c) a piston member fixedly mounted on the portion of said shaft member located in said cylindrical bore, said piston member having opposing surfaces;

(d) passageway means in said housing for communicating fluid pressure sources to respective opposing surfaces of said piston, such that such fluid pressures act on said piston member such that the differential pressure causes axial movement of said shaft member in a first direction toward said spring housing bore upon higher fluid pressure on the first surface of said piston member and a second direction, away from said spring housing bore, upon higher fluid pressure on the second surface of said piston member;

(e) a fixed shoulder stop formed on said shaft member adjacent said piston member;

(f) an adjustable stop coupled to the end of said shaft member adjacent said spring housing bore, said adjustable stop being axially spaced apart from said fixed shoulder stop;

(g) spring means disposed between said fixed shoulder stop and said adjustable stop for providing a biasing force against said fixed shoulder stop upon movement of said shaft member in said first direction, and against said adjustable stop upon movement of said shaft member in said second direction;

(h) an abutting portion formed in said housing adjacent said fixed shoulder stop and positioned to contact the end of said spring means bearing against said fixed shoulder stop as said shaft member moves in said first direction;

(i) an adjustable abutting member attached to said housing adjacent said adjustable stop and positionable within an axial range to contact the end of said spring means bearing against said adjustable stop as said shaft member moves in said second direction;

(j) a switch means attached to said housing for selectively providing an electrical connection indicating the pressure relationship between fluid pressure sources;

(k) a switch operator means extending from said piston member for engaging said switch means in response to axial movement of said piston member;

(l) sealing means for enclosing said spring housing bore; and (m) a reduced passageway formed in said housing such that said enclosed spring housing bore is in communication with a portion of said cylindrical bore.

16. A fluid pressure switch as set forth in claim 15, wherein said switch means includes a first contact arm secured on one end to said housing, a first contact member secured to the opposite end of said first contact arm, a second contact arm secured to said housing in parallel relation to said first contact arm at the end corresponding to said secured end of said first contact arm, a second contact member secured to the end of said second contact arm corresponding to said contact end of said first contact arm, a stop member secured to said housing between said parallel first and second contact arms, and a tension spring secured to said first and second contact arms such that, movement of said first contact arm initially results in a following movement by said second contact arm until said second contact arm contacts said contact stop halting further following movement, and vice versa, where movement of said second contact arm initially results in a following movement by said first contact arm until said first contact arm contacts said contact stop halting further following movement.

17. A fluid pressure switch as set forth in claim 15, wherein said switch operator means includes an elliptically-shaped eccentric portion axially rotatable such that a range of displacement of said shaft member over which said switch means operates is provided.

18. A fluid pressure switch, as set forth in claim 17, wherein said piston member includes an extension collar portion secured to said shaft member intermediate a first and a second cup-shaped portion of said piston member, said first and second cup-shaped portions forming respectively, said first and second surfaces of said piston member, said extension collar portion further securing said switch operator portion to said shaft member allowing axial movement therewith.

* * * * *